US005615991A

United States Patent [19]

Chung

[11] Patent Number: 5,615,991

[45] Date of Patent: Apr. 1, 1997

[54] VARIABLE PRIORITY DEVICE FOR HEAVY CONSTRUCTION EQUIPMENT

[75] Inventor: Dae S. Chung, Pusan, Rep. of Korea

[73] Assignee: Samsung Heavy Industries Co., Ltd., Seoul, Rep. of Korea

[21] Appl. No.: 497,173

[22] Filed: Jun. 30, 1995

[30] Foreign Application Priority Data

Sep. 30, 1994 [KR] Rep. of Korea ..... 94-25345

[51] Int. Cl.[6] ..... F15B 13/08

[52] U.S. Cl. ..... 414/685; 91/31; 91/33

[58] Field of Search ..... 414/685, 699; 91/27, 31, 32, 33, 529, 414, 91

[56] References Cited

U.S. PATENT DOCUMENTS

| | | | |
|---|---|---|---|
| 3,927,603 | 12/1975 | Bernhoft | 91/529 |
| 3,977,100 | 8/1976 | Boersmo | 91/529 |
| 4,508,013 | 4/1985 | Barbagli | 91/529 |
| 4,875,337 | 10/1989 | Sugiyama | 91/529 |
| 5,107,753 | 4/1992 | Ioku | 91/529 |

*Primary Examiner*—Karen B. Merritt
*Assistant Examiner*—Gregory A. Morse
*Attorney, Agent, or Firm*—Kenyon & Kenyon

[57] ABSTRACT

A variable priority device for heavy construction equipment for establishing a priority of the boom over the bucket by limiting an amount of fluid passing through a bucket-side parallel fluid line when the boom operates alone and thereby decreasing the amount of fluid supplied to the bucket actuator. The device is installed in the bucket-side parallel fluid line and adapted to be switched between an orifice state and an orifice release state, the priority control valve being initially maintained at the orifice release state by a resilience device while being switched from the orifice release state to the orifice state against a resilience of the resilience device in response to a pilot pressure for moving the spool of a boom-side switching valve communicating with the boom actuator.

1 Claim, 2 Drawing Sheets

VARIABLE PRIORITY DEVICE FOR HEAVY CONSTRUCTION EQUIPMENT

BACKGROUND OF THE INVENTION

1. Field of the Invention

The present invention relates to hydraulic devices for heavy construction equipment, and more particularly to a variable priority device for the swing motor of heavy construction equipment.

2. Description of the Prior Art

Where at least two actuators are operated by a single pump, a "priority" is established to control the actuators such that one of the actuators is supplied with a larger amount of oil than the other actuator. For example, in an excavator wherein actuators respectively adapted to actuate a boom and a bucket are supplied with operating oil from a single pump, the amount of oil required for a boom operation is considerably larger than the amount of oil required for a bucket operation. To this end, a priority is assigned to the boom by limiting the amount of oil supplied to the bucket and increasing the amount of oil supplied to the boom by the limited amount of oil. Such a relationship is also applied to a case wherein the arm actuator should have a priority over the swing actuator.

In order to provide such a priority function, a stroke limiter or an orifice has been used. Referring to FIG. 1, an example of the stroke limiter is illustrated. As shown in FIG. 1, the stroke limiter, which is denoted by the reference numeral 101, is provided at a bucket-side switching valve 103 to limit the spool stroke of the switching valve 103 within a desired range, thereby preventing a supply oil passage 105 defined in the switching valve 103 from being fully opened. An example of the orifice is illustrated in FIG. 2. The orifice denoted by the reference numeral 201 in FIG. 2 is disposed in a bucket-side parallel oil line 203 to limit the amount of oil supplied to a bucket-side switching valve 205.

In either case, namely, where the supply oil passage defined the bucket-side switching valve is prevented from being fully opened by the stroke limiter or where the bucket-side parallel oil line is limited on the oil amount passing therethrough by the orifice, the amount of oil supplied to the cylinder for the bucket is reduced, while the limited amount of oil is additionally supplied to the other actuator, namely, the cylinder for the boom. In such a manner, the boom has a priority over the bucket.

However, the above-mentioned conventional devices have a problem that the oil passage or line is always limited on the oil amount passing therethrough, irrespective of whether the actuator associated operates alone or in combination with the other actuator. In other words, although the boom desirably has the priority over the bucket by the function of the stroke limiter or orifice when both the bucket and the boom operate in a combined manner, the bucket-side oil line is also limited undesirably on the oil amount passing therethrough even when the bucket operates alone. In the latter case, the limitation on the amount passing through the bucket-side oil line results in various problems such as unnecessary loss of pressure, heat generation caused by the overload and a decrease in the operating speed of the bucket.

SUMMARY OF THE INVENTION

Therefore, an object of the invention is to provide a variable priority device for heavy construction equipment capable of providing an orifice function, when a bucket and a boom operate in a combined manner, to decrease the amount of fluid supplied to a bucket of the heavy construction equipment and correspondingly increase the amount of fluid supplied to the boom of the equipment, thereby enabling the boom to have a priority over the bucket, while releasing the orifice function when the bucket operates alone, thereby supplying a sufficient amount of fluid to the bucket.

In accordance with the present invention, this object can be accomplished by providing in a hydraulic apparatus for heavy construction equipment adapted to supply fluid delivered from a single pump to a boom actuator and a bucket actuator respectively via parallel fluid lines, a variable priority device for a boom comprising means for limiting the amount of fluid passing through the bucket-side parallel fluid line when the boom operates alone and thereby decreasing the amount of fluid supplied to the bucket actuator.

In accordance with a preferred embodiment of the present invention, the means comprises a priority control valve installed in the bucket-side parallel fluid line and adapted to be switched between an orifice state and an orifice release state, the priority control valve being initially maintained at the orifice release state by resilience means while being switched from the orifice release state to the orifice state against a resilience of the resilience means in response to a pilot pressure for moving the spool of a boom-side switching valve communicating with the boom actuator.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

Figure 1:
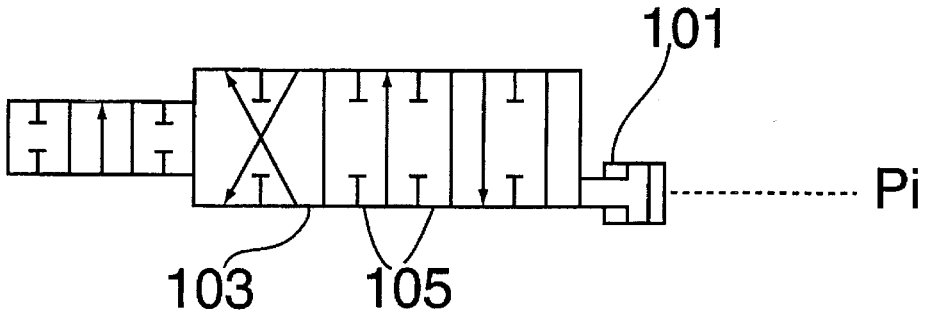
FIG. 1 PRIOR ART
FIG. 1 is a hydraulic circuit diagram illustrating a stroke limiter installed in a bucket-side switching valve for establishing a priority function for a boom in a conventional manner.
Figure 2:
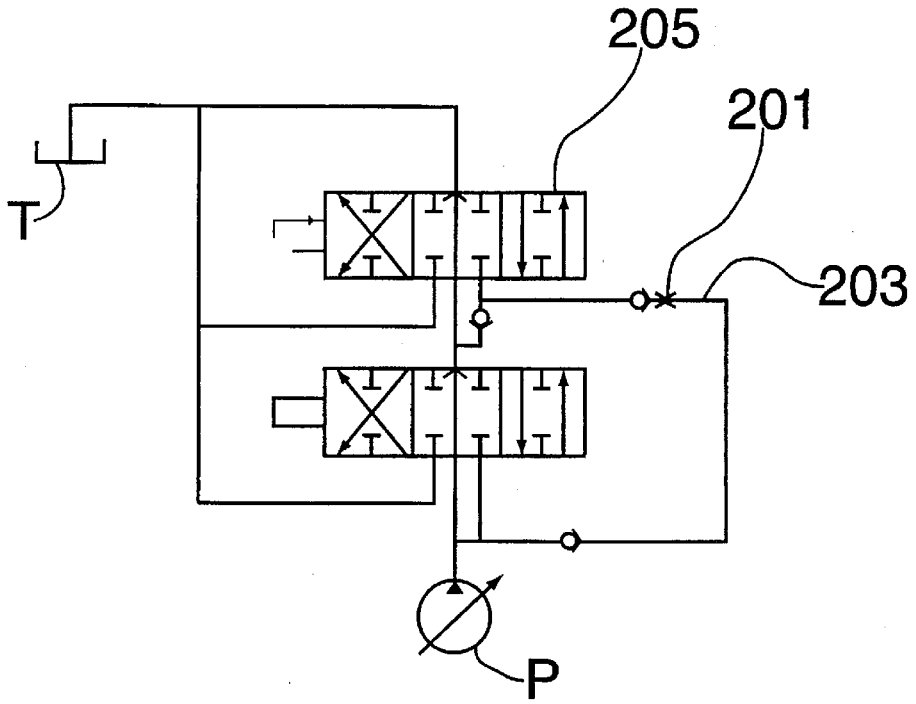
FIG. 2 PRIOR ART
FIG. 2 is a hydraulic circuit diagram illustrating an orifice installed in a bucket-side switching valve for establishing a priority function for a boom in a conventional manner.
Figure 3:
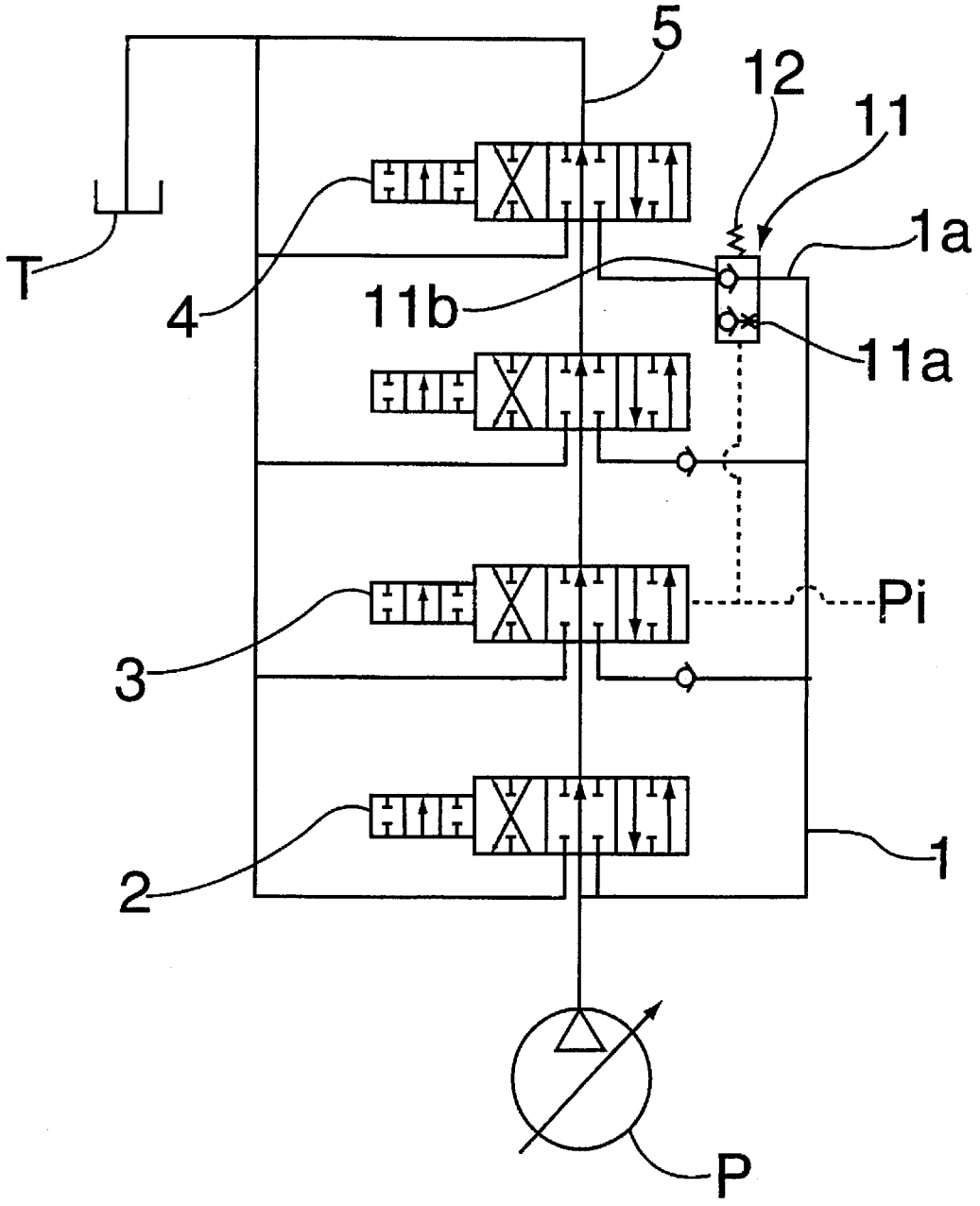
FIG. 3 is a hydraulic circuit diagram illustrating a variable priority device for a boom in accordance with an embodiment of the present invention.

Referring to FIG. 3, there is illustrated a variable priority device for heavy construction equipment in accordance with an embodiment of the present invention.

In the heavy construction equipment shown in FIG. 3, fluid pumped by a single pump P is supplied to a plurality of actuators (not shown) in an independent or combined manner via a parallel fluid line 1. The reference numeral 2 denotes a switching valve for supplying the fluid to a travel actuator, namely, a travel motor, 3 a boom-side switching valve for supplying the fluid to a boom actuator, namely, a boom cylinder, and 4 a bucket-side switching valve for supplying the fluid to a bucket actuator, namely, a bucket cylinder.

When all the switching valves 2, 3 and 4 are maintained in their neutral positions, respectively, the fluid delivered from the pump P is returned directly to a tank T via a center bypass line 5.

An arm cylinder-side parallel fluid line 1*a* is connected between the parallel fluid line 1 and the bucket actuator. The arm cylinder-side parallel fluid line 1*a* is provided with means 11 for limiting the amount of fluid passing through the arm cylinder-side parallel fluid line 1*a* during the operation of the boom and thereby decreasing the amount of fluid supplied to the bucket actuator. The means 11 may comprise a priority control valve adapted to sense the operation of the boom, namely, a pilot pressure Pi for moving the spool (not shown) of the boom-side switching valve 3 and thereby performing its switching between an orifice state 11*a* and an orifice release state 11*b*.

Construction of the priority control valve 11 will now be described in detail. The priority control valve 11 has two inner fluid passages respectively corresponding to two states 11*a* and 11*b* of the priority control valve 11. The first inner fluid passage corresponding to the orifice state 11*a* is provided with an orifice and a check valve whereas the second inner fluid passage corresponding to the orifice release state 11*b* is provided with only a check valve. That is, the priority control valve 11 communicates with the parallel fluid line 1 through one of its inner fluid passages selected by the movement of its spool so that it is switched between the orifice state 11*a* and the orifice release state 11*b*. The priority control valve 11 is set to be initially maintained at the orifice release state 11*b*, by a pressure setting spring 12 which is resilience means with a predetermined pressure always biasing the spool of priority control valve 11. The priority control valve 11 is constructed to receive a pilot pressure Pi for moving the spool of boom-side switching valve 3 against the resilience of pressure setting spring 12. Upon receiving the pilot pressure Pi, the priority control valve 11 is switched to the orifice state 11*a*. When the priority control valve 11 is switched to the orifice state 11*a* in response to the above-mentioned movement of the spool of boom-side switching valve 3, namely, the operation of the boom actuator, it limits the amount of fluid supplied to the switching valve 4 via the parallel fluid lines 1 and 1*a* by its orifice function obtained at the orifice state 11*a*. As a result, an amount of fluid corresponding to the limited amount of fluid is additionally supplied to the switching valve 3. Thus, the priority of the boom actuator over the bucket actuator is established.

As apparent from the above description, in accordance with the present invention, it is possible to variably adjust the arm bucket-side parallel fluid line such that the orifice function thereof is exerted and released selectively depending on whether or not the boom is operating, namely, whether or not the pilot pressure for moving the spool of boom-side switching valve is generated. Accordingly, the priority of the boom over the bucket is established by the orifice function during the combined operation of the boom and bucket, whereas when the bucket operates alone, the orifice function is released so that a sufficient amount of fluid may be normally supplied to the arm cylinder-side.

By virtue of the variable orifice function provided in accordance with the present invention, consequently, it is possible to avoid the loss of fluid pressure and the generation of heat due to the overload both involved in conventional priority devices when the bucket operates alone, thereby considerably increasing the operation speed of the bucket.

Although the preferred embodiment of the invention has been disclosed for illustrative purposes, those skilled in the art will appreciate that various modifications, additions and substitutions are possible, without departing from the scope and spirit of the invention as disclosed in the accompanying claims.

What is claimed is:

1. In a hydraulic apparatus for heavy construction equipment adapted to supply fluid delivered from a single pump to a boom actuator and a bucket actuator respectively via parallel fluid lines, a variable priority device for a boom comprising:

means for limiting an amount of fluid passing through the bucket-side parallel fluid line when the boom operates alone and thereby decreasing an amount of fluid supplied to the bucket actuator, said means for limiting comprising a priority control valve installed in the bucket-side parallel fluid line and adapted to be switched between an orifice state and an orifice release state, and resilience means for initially maintaining the priority control valve at the orifice release state while being switched from the orifice release state to the orifice state against resilience of the resilience means in response to a pilot pressure for moving the spool of a boom-side switching valve communicating with the boom actuator.

* * * * *